US006260446B1

(12) United States Patent
Hu

(10) Patent No.: US 6,260,446 B1
(45) Date of Patent: Jul. 17, 2001

(54) LOCKING STRUCTURE FOR SCREWDRIVER

(76) Inventor: Michael Hu, No. 25, Tu Tzu Tou, Tu Tou Village, Kuan Tien Shiang, Tainan Hsien (TW)

( * ) Notice: Subject to any disclaimer, the term of this patent is extended or adjusted under 35 U.S.C. 154(b) by 0 days.

(21) Appl. No.: 09/495,784

(22) Filed: Feb. 1, 2000

(51) Int. Cl.[7] ..... B25B 13/46
(52) U.S. Cl. ..... 81/62
(58) Field of Search ..... 81/58, 58.4, 61, 81/62, 63, 63.1

(56) References Cited

U.S. PATENT DOCUMENTS 5,535,648 * 7/1996 Braun et al. ..... 81/63.1
5,613,585 * 3/1997 Tiede ..... 81/62
6,047,617 * 4/2000 Chen ..... 81/63.1

* cited by examiner

*Primary Examiner*—Joseph J. Hail, III
*Assistant Examiner*—David B Thomas
(74) *Attorney, Agent, or Firm*—Rosenberg, Klein & Lee

(57) ABSTRACT

A screwdriver locking structure including a handle, a socket, a ratchet wheel, a pair of blocks with springs, a bearing and a ring, the handle comprises a barrel at one end to receive the socket which then connects to the ratchet wheel. The barrel further receives the blocks and springs which urge the blocks meshing with the ratchet wheel in an opposing direction. The ring comprises a board and a side wall, the plate comprises a pair of protuberances at inside which engage with the blocks when the ring rotates, and the side wall comprises recesses, one of which remains contact with the bearing.

1 Claim, 4 Drawing Sheets

LOCKING STRUCTURE FOR SCREWDRIVER

BACKGROUND OF THE INVENTION

1. Field of the Invention

This invention relates to a screwdriver locking structure, and more particularly to a screwdriver being able to change its direction of rotation by operating a ring.

2. Description of Prior Art

A screwdriver has been changed from a fixed type to a single rotation direction of the latest design. The latest design uses a sliding switch to control a leverage type block to engage with a ratchet wheel, thus to determine the direction of rotation. Although this design is convenient at the beginning, but users sometimes find they are confused with the direction and may switch accidentally.

SUMMARY OF THE INVENTION

It is the primary object of the present invention to provide a screwdriver locking structure which is easy to operate.

It is another object of the present invention to provide a screwdriver locking structure which is dust-proof and more precise.

DETAILED DESCRIPTION OF THE INVENTION

Figure 1:
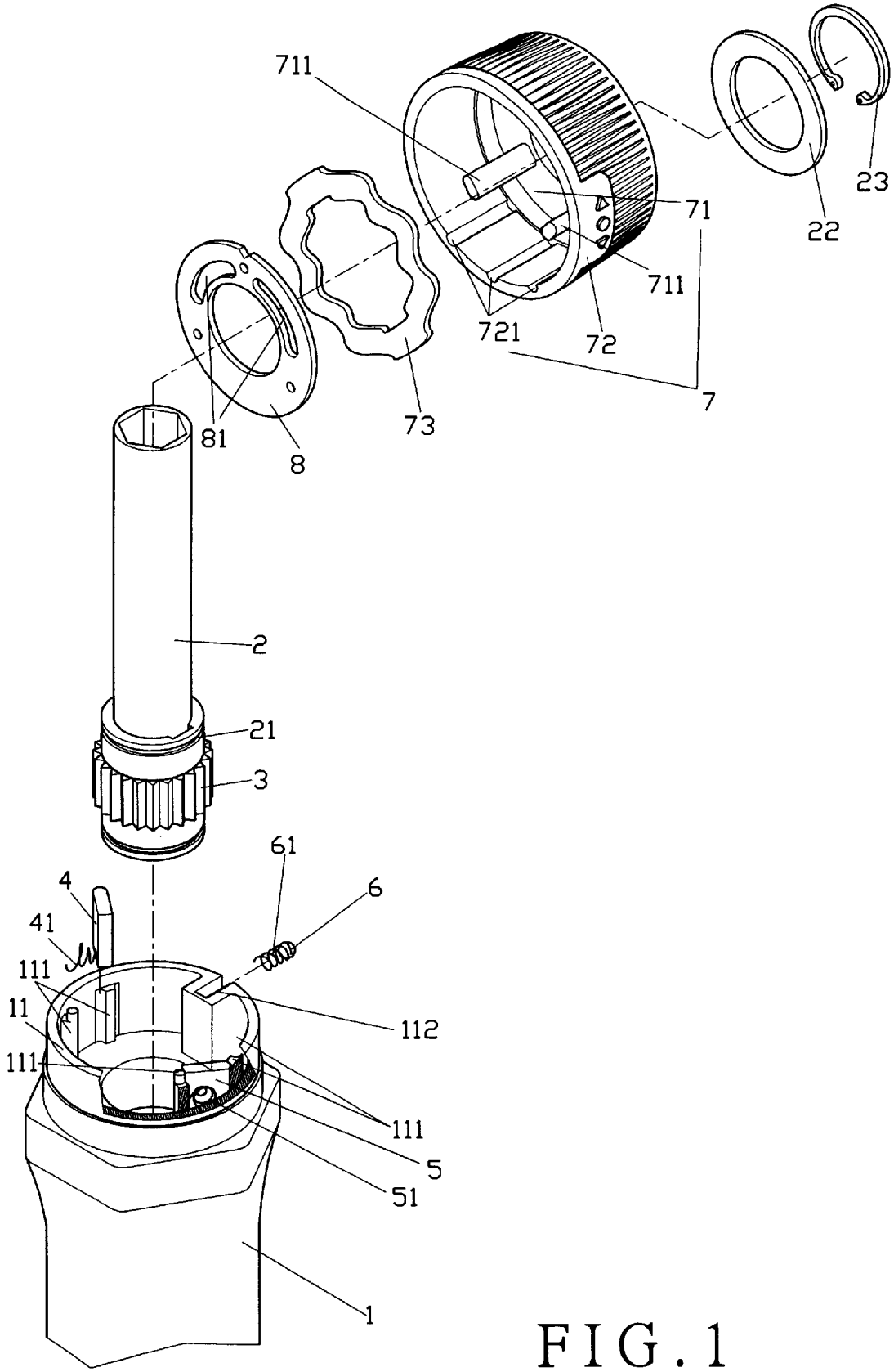
FIG. 1 is an exploded view of the present invention.

The present invention of a screwdriver locking structure, as shown in FIG. 1, comprises a handle 1, a socket 2, a ratchet wheel 3, a pair of blocks 4 and 5, and corresponding springs 41 and 51, a bearing 6, a ring 7 and a dust cover 8.

The handle 1 has a barrel 11 at one of the ends adapted to receive the socket 2 therein, then the socket 2 is connected to the ratchet wheel 3. The socket 2 comprises a circular recess 21, an O-ring 22 and a snap ring 23. The barrel 11 comprises ribs 111 extending from the inside wall thereof to confine movements of the blocks 4 and 5, the springs 41 and 51 and the bearing 6. The barrel 11 further comprises a trough 112 which is to accommodate the bearing 6 and a spring 61 in such a manner that the spring 61 urges the bearing 6 outward the trough 112. The blocks 4 and 5 are also urged by springs 41 and 51 towards an opposing direction of the ratchet wheel 3.

The ring 7 comprises an end wall 71, a side wall 72 and a washer 73, wherein the end wall 71 has a pair of posts 711 extending inwardly, the posts which will engage with one of the blocks 4 or 5 when the ring 7 rotates. The side wall 72 has a number of recesses 721, upon the ring 7 sleeves onto the barrel 11, the bearing 6 urged by the spring 61 will extend into one of the recesses 721 that holds the ring 7 at a fixed position.

The dust cover 8 is sleeved onto the barrel 11 and stayed inside of the end wall 71 of the ring 7, and is composed of two slots 81 for the posts 711 to extend through there, respectively as confinement of the two posts 711.

Figure 2:
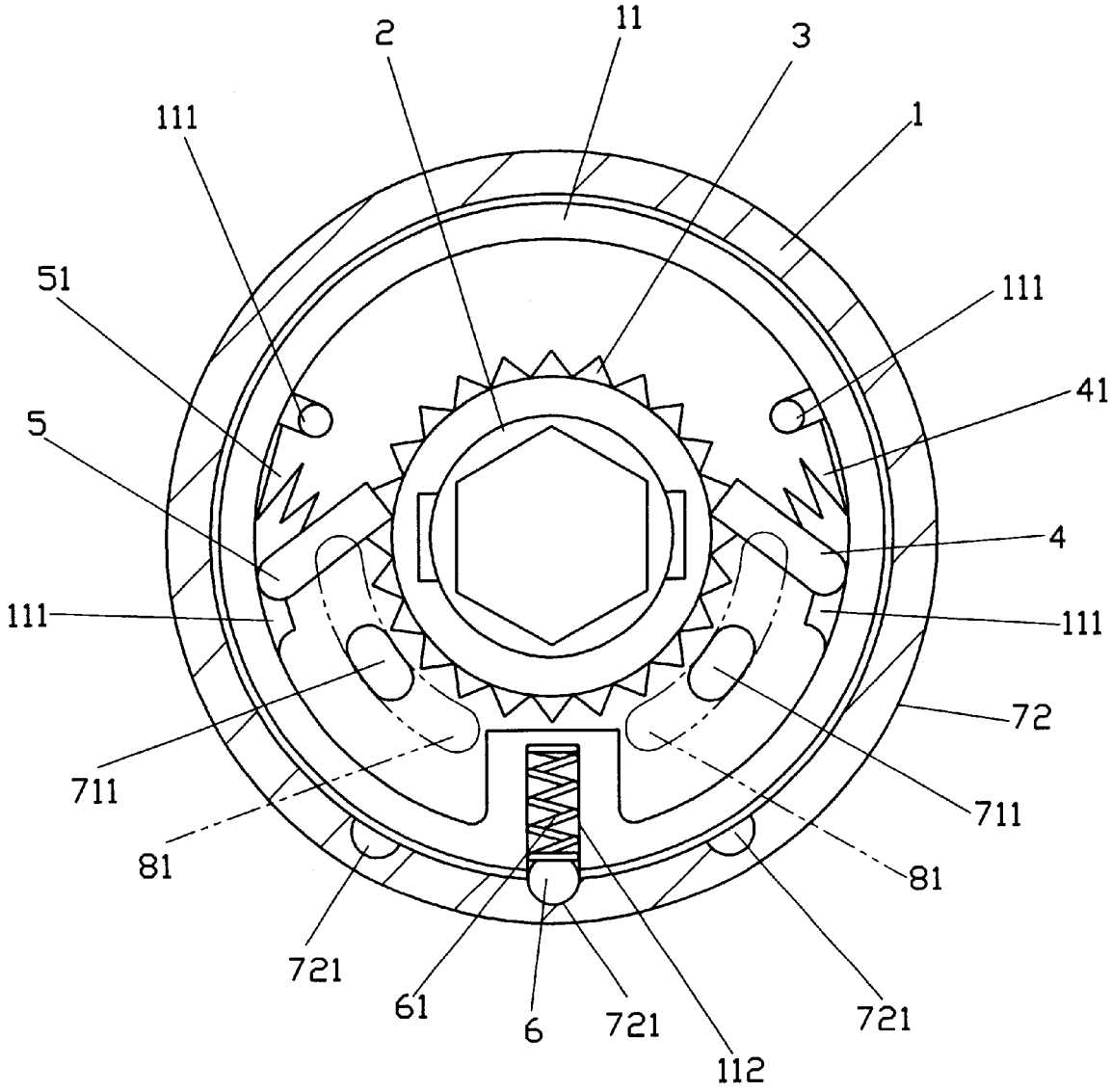
FIG. 2 is a top cross sectional view of the present invention.

To assemble, refer to the FIGS. 1 and 2, install the bearing 6, the blocks 4 and 5 and springs 41 and 51 at place in the barrel 11, and put the dust cover 8 and the washer 73 on the barrel 11 in sequence. Then extend the posts 711 through the slots 81 of the dust cover 8, and press the ring 7 so as the bearing 6 is urged by the spring 61 into the recess 721, sleeve the O-ring 22 into the socket 2 and seal the circular recess 21 with the snap ring 23, thus the screwdriver locking structure of the present invention is completed.

Figure 3:
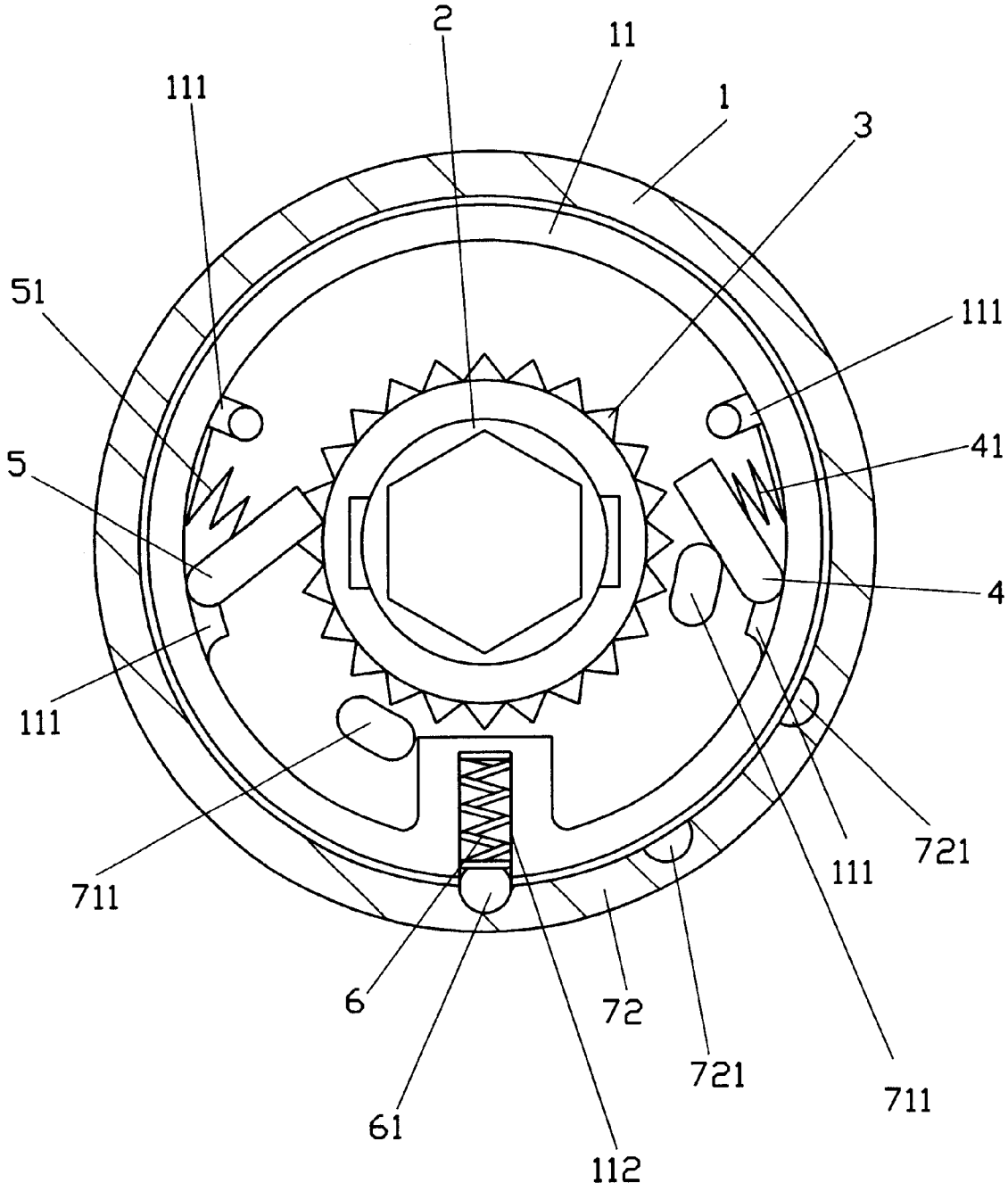
FIG. 3 is a top view showing a first operation status.
Figure 4:
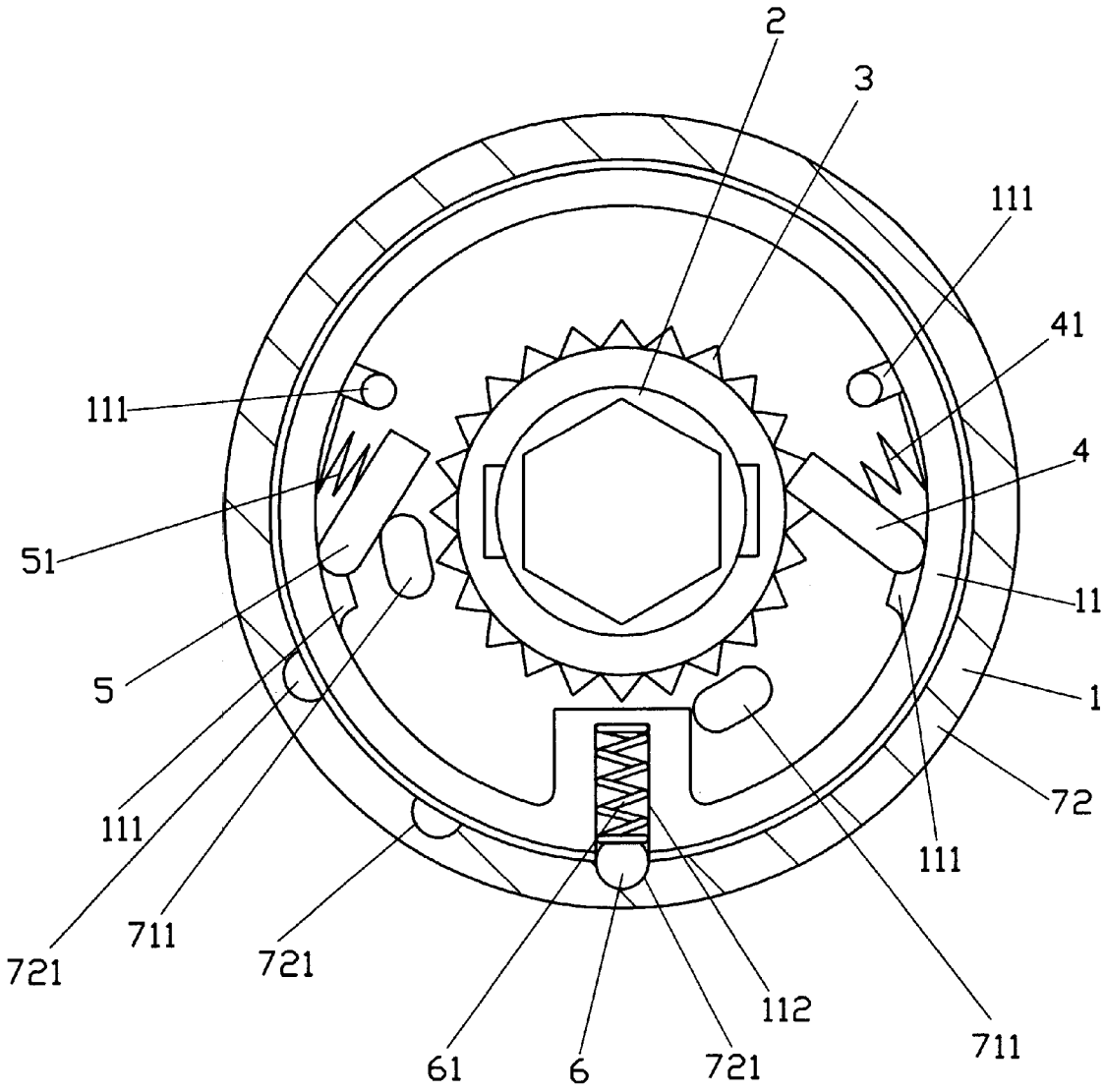
FIG. 4 is another top view showing a second operation status.

In practice, as shown in FIG. 2, the ring 7 is not turned, the two posts 711 extending through the slots 81 are not engaging with either blocks 4 or 5. The handle 1, the socket 2 and the ratchet wheel 3 are engaging with each other. However, when the ring 7 turns, as shown in FIG. 3, one of the posts 711 engages with the block 4 and urges the spring 41 that forces the block 4 from disengaging with the ratchet wheel 3. whereas the other block 5 is still engaging with the ratchet wheel 3, thus the handle 1, the socket 2 and the ratchet wheel 3 are turning towards one direction (in this showing, its turning counterclockwise), should the handle 1 turning opposing direction, the socket 2 and the ratchet wheel 3 will be in an idle status. FIG. 4 shows an opposed status which illustrates that post 711 forces the block 5 from disengaging with the ratchet wheel 3, while the other block 4 is still engaged with the ratchet wheel 3 which allows the handle 1 to rotate in a clockwise direction.

I claim:

1. A locking structure for a screwdriver comprising a handle, a socket, a ratchet wheel, two blocks, a pair of first springs, a bearing, a second spring, a dust cover, and a ring, said handle having a barrel at one end to accommodate said socket therein, said barrel having a trough for receiving said second spring and bearing therein, said socket being sleeved with said ratchet wheel, an O-ring sleeved on said socket adjacent said ratchet, said blocks and springs being seating in said barrel, said blocks having a planar end surface protruding into said ratchet wheel and each engaging a respective tooth thereof, said ring including an end wall and a side wall, said side wall having a plurality of recesses formed in an inside surface for said bearing to extend therein to provide a detent function, said end wall of said ring having two posts extending inwardly therefrom, said dust cover being disposed in said barrel adjacent said end wall of said ring, said dust cover having a pair of arcuate slots formed there in for said two posts to respectively pass therethrough, wherein one of said posts will engage with one of said blocks to displace said one block from its engagement with said ratchet wheel responsive to a rotative displacement of said ring from a first position to one of a pair of second positions relative to said handle, and be disengaged from both said blocks responsive to said ring being disposed in said first position.

* * * * *